US005498483A

United States Patent [19]

Ito et al.

[11] Patent Number: 5,498,483

[45] Date of Patent: Mar. 12, 1996

[54] WEAR-RESISTANT SINTERED FERROUS ALLOY FOR VALVE SEAT

[75] Inventors: Kozo Ito; Yoshishige Takano, both of Hyogo, Japan

[73] Assignee: Sumitomo Electric Industries, Ltd., Osaka, Japan

[21] Appl. No.: 430,383

[22] Filed: Apr. 28, 1995

[30] Foreign Application Priority Data

Nov. 9, 1994 [JP] Japan ..... 6-274891

[51] Int. Cl.[6] ..... B22F 7/00

[52] U.S. Cl. ..... 428/552; 428/546; 428/567; 428/568

[58] Field of Search ..... 251/368; 420/34, 420/104; 75/228, 230, 236, 243, 246, 247; 428/546, 567, 568, 552

[56] References Cited

U.S. PATENT DOCUMENTS

| | | | |
|---|---|---|---|
| 4,505,988 | 3/1985 | Urano et al. | 428/569 |
| 5,031,878 | 7/1991 | Ishikawa et al. | 251/368 |

FOREIGN PATENT DOCUMENTS

| | | | |
|---|---|---|---|
| 58178073 | 1/1984 | Japan | F16K 17/34 |
| 59-25959 | 5/1984 | Japan | C22C 38/44 |
| 60258450 | 5/1986 | Japan | C22C 38/10 |
| 61179857 | 1/1987 | Japan | C22C 38/52 |
| 3225008 | 12/1991 | Japan | F01L 3/02 |
| 0543916 | 6/1993 | Japan | B22F 5/00 |

OTHER PUBLICATIONS

Production of Rapidly Solidified Metals and Alloys, *Journal Of Metals*, Apr. 1984, pp. 20–22.

*Primary Examiner*—Donald P. Walsh
*Assistant Examiner*—John N. Greaves
*Attorney, Agent, or Firm*—Sughrue, Mion, Zinn, Macpeak & Seas

[57] ABSTRACT

A wear-resistant sintered ferrous alloy for use as a valve seat, the alloy comprising an iron-based matrix having a sorbite or pearlite structure consisting of 0.5 to 1.5% by weight of C, 0.5 to 3% by weight of Ni, 0.5 to 2% by weight of Mo, 0.1 to 8% by weight of Co, 0.05 to 1% by weight of Mn, and the balance of Fe, with unavoidable impurities, and having a Vickers hardness of from 300 to 450; hard particles A consisting of 1.5 to 2.5% by weight of C, 38 to 45% by weight of Cr, 18 to 30% by weight of W, 5 to 15% by weight of Co, 0.5 to 3% by weight of Mo, 0.03 to 0.5% by weight of Ti, and the balance of Fe, with unavoidable impurities, and having an average particle diameter of from 30 to 80μm; and hard particles B consisting of 60 to 70% by weight of Mo, 0.5 to 2% by weight of Si, and the balance of Fe, with unavoidable impurities, and having an average particle diameter of from 30 to 80 μm, the hard particles A and the hard particles B being uniformly dispersed in the iron-based matrix in a total amount of from 10 to 25% by weight based on the total weight of the iron-based matrix, the hard particles A, and the hard particles B.

9 Claims, No Drawings

WEAR-RESISTANT SINTERED FERROUS ALLOY FOR VALVE SEAT

FIELD OF THE INVENTION

The present invention relates to a wear-resistant sintered ferrous alloy suitable for use as the material of valve seats for automotive engines, particularly as the material of valve seats having excellent wear resistance and suitable for high-load high-rotation-speed engines.

BACKGROUND OF THE INVENTION

As a result of the recent trend toward performance increase and power increase in automotive engines, the conditions under which valve seats are repeatedly knocked by the valves at high temperatures are becoming severer increasingly. Hence, there is a growing desire for an improvement in the wear resistance of valve seats themselves.

Most of the current valve seats are made of sintered ferrous alloy materials. Examples thereof include a copper-infiltrated sintered ferrous alloy material comprising an Fe matrix containing alloying elements, e.g., Co and Ni; C—Cr—W—Co—Fe or Fe—Mo hard particles dispersed in the matrix; and copper infiltrated in pores in the matrix, so as to maintain wear resistance, as disclosed, e.g., in JP-A-59-25959 and U.S. Pat. No. 4,505,988. (The term "JP-A" as used herein means an "unexamined published Japanese patent application.")

Although the conventional valve seats made of the above-described sintered ferrous alloy material has certain wear resistance, it tends to cause considerable wear of valve seats themselves and valves when used in automotive engines especially of the high-load high-rotation-speed type because of the great knocking and sliding impacts caused by the valves.

This is because the impacts caused by valve knocking is concentrated on hard particles to cause the hard particles to break and fall from the iron-based matrix. Wear thus proceeds and, at the same time, the hard particles which have fallen from the matrix attack not only the valve seats but also the valves to accelerate the wear of both.

Furthermore, since a combustion gas in high-load high-rotation-speed engines has high temperatures, metal adhesion is apt to occur due to the sliding impacts caused by the valves, and thus the wear of both the valve seats and the valves tends to become severer.

SUMMARY OF THE INVENTION

An object of the present invention is to provide a wear-resistant sintered ferrous alloy for use as valve seats which alloy can prevent the breakage of hard particles contained in the alloy, prevent the falling of hard particles from valve seats made of the alloy, prevent the wear caused by adhesion, and reduce the wear of the valve seats and valves.

The above and other objects and effects of the present invention will be apparent from the following description.

To accomplish the above objects of the present invention, investigations have been made by the present inventors on compositions and structures of matrixes, and as a result, it has been found that the improvement of the matrix ductility not only improves the ability to hold hard particles but also buffers the impacts on hard particles, thereby inhibiting the breakage and falling of the hard particles. Investigations have also been made on compositions, particle diameters, and contents of the hard particles so as to effectively improve resistance to wear by the impacts caused by valves.

As a result of these investigations, the wear-resistant sintered ferrous alloy for use as a valve seat, according to the present invention, has been completed.

The present invention relates to a wear-resistant sintered ferrous alloy for use as a valve seat, the alloy comprising an iron-based matrix having a sorbite or pearlite structure consisting of 0.5 to 1.5% by weight of C, 0.5 to 3% by weight of Ni, 0.5 to 2% by weight of Mo, 0.1 to 8% by weight of Co, 0.05 to 1% by weight of Mn, and the balance of Fe, with unavoidable impurities, and having a Vickers hardness of from 300 to 450;

hard particles A consisting of 1.5 to 2.5% by weight of C, 38 to 45% by weight of Cr, 18 to 30% by weight of W, 5 to 15% by weight of Co, 0.5 to 3% by weight of Mo, 0.03 to 0.5% by weight of Ti, and the balance of Fe, with unavoidable impurities, and having an average particle diameter of from 30 to 80μm; and hard particles B consisting of 60 to 70% by weight of Mo, 0.5 to 2% by weight of Si, and the balance of Fe, with unavoidable impurities, and having an average particle diameter of from 30 to 80 μm, the hard particles A and the hard particles B being uniformly dispersed in the iron-based matrix in a total amount of from 10 to 25% by weight based on the total weight of the iron-based matrix, the hard particles A, and the hard particles B.

The present invention also relates to a sintered ferrous alloy for use as a valve seat which is the wear-resistant sintered ferrous alloy of the present invention described above which further comprising $CaF_2$ uniformly dispersed in the matrix in an amount of from 0.3 to 2% by weight based on the total amount of the alloy and/or Cu incorporated in pores of the matrix by infiltration in an amount of from 10 to 20% by volume based on the total amount of the alloy.

DETAILED DESCRIPTION OF THE INVENTION

For inhibiting the breakage and falling of hard particles, it is necessary to improve the ability of the matrix to hold the hard particles and also improve the ability thereof to buffer impacts on the hard particles. Higher matrix ductility is desirable for attaining these objects. At the same time, wear resistance of the matrix itself is also necessary. From these standpoints, the structure of the matrix should be sorbite or pearlite.

If a ferrite or austenite (including retained austenite) structure is present in the matrix even partly, wearing proceeds from that structure because such structure has poor wear resistance although having high ductility. Therefore, these structures should be removed from the matrix by controlling the conditions for cooling or heat treatment after sintering.

If the hardness of a matrix is less than 300 in terms of Vickers hardness, wear resistance cannot be ensured. If the Vickers hardness thereof exceeds 450, ductility cannot be ensured. Hence, for obtaining a matrix that exhibits both wear resistance and ductility simultaneously, the matrix should have a hardness of from 300 to 450 in terms of Vickers hardness.

The matrix is explained below with respect to its composition.

Carbon (C) is an element important to ensure the wear resistance and strength of the iron matrix, and the content thereof is from 0.5 to 1.5% by weight, and preferably from 0.8 to 1.2% by weight. This is because C contents lower than 0.5% by weight make it impossible to ensure wear resistance required of valve seats, while C contents higher than 1.5% by weight result in the excessive generation of carbides to reduce toughness and strength.

Nickel (Ni) is an element effective in improving the ductility of the matrix. If the Ni content is lower than 0.5% by weight, the incorporation of Ni is less effective. Ni contents higher than 3% by weight result in the excessive generation of retained austenite to reduce wear resistance. Consequently, the content of Ni is from 0.5 to 3% by weight, and preferably from 0.5 to 2.2% by weight.

Molybdenum (Mo) is an element effective in improving the wear resistance of the matrix. If the Mo content is lower than 0.5% by weight, the incorporation of Mo is less effective. Mo contents higher than 2% by weight result in the excessive carbide generation to reduce the ductility and toughness of the matrix. Consequently, the content of Mo is from 0.5 to 2% by weight, and preferably from 0.8 to 1.8% by weight.

Cobalt (Co) is an element effective in improving the ductility and wear resistance of the matrix. If the Co content is lower than 0.1% by weight, the incorporation of Co is less effective. Even if Co is incorporated in amounts larger than 8% by weight, the effect of Co incorporation cannot be heightened any more. Consequently, the content of Co is from 0.1 to 8% by weight, and preferably from 0.1 to 5.5% by weight.

Manganese (Mn) is an element effective in reducing intergranular brittleness to improve ductility. If the Mn content is lower than 0.05% by weight, the incorporation of Mn is less effective. Even if Mn is incorporated in amounts larger than 1% by weight, the effect of Mn incorporation cannot be heightened any more. Consequently, the content of Mn is from 0.05 to 1% by weight, and preferably from 0.05 to 0.5% by weight.

By controlling the structure and composition of the matrix as described above, not only the ability of the matrix to hold hard particles can be improved, but also the matrix can provide function of buffering impacts on hard particles. As a result, the breakage and falling of hard particles due to the impacts caused by valves can be inhibited.

The hard particles A are explained below with respect to the composition thereof.

Carbon (C) forms carbides to improve wear resistance. If the C content is lower than 1.5% by weight, only a limited amount of carbides are formed, so that sufficient wear resistance cannot be ensured. C contents higher than 2.5% by weight result in the excessive generation of carbides to reduce the toughness of the hard particles, which therefore are apt to break and fall off due to the knocking impacts caused by valves. Consequently, the content of C is from 1.5 to 2.5% by weight, and preferably from 1.7 to 2.3% by weight.

Chromium (Cr) forms a carbide in the hard particles to improve wear resistance. If the Cr content is lower than 38% by weight, the incorporation of Cr is less effective. Cr contents higher than 45% by weight result in the excessive carbide formation to reduce the toughness of the hard particles. Consequently, the content of Cr is from 38 to 45% by weight.

Tungsten (W) also forms a carbide to improve wear resistance. If the W content is lower than 18% by weight, the incorporation of W is less effective. W contents higher than 30% by weight result in the excessive carbide formation to reduce toughness. Consequently, the content of W is from 18 to 30% by weight, and preferably from 19 to 27% by weight.

Cobalt (Co) enhances bonding between the hard particles and the matrix because it diffuses in an extremely small amount into the matrix during sintering to form a solid solution of Co in the matrix. Cobalt also forms a binder phase serving as the matrix of each hard particle, to thereby show the effect of improving the toughness of the hard particles. If the Co content is lower than 5% by weight, the incorporation of Co is less effective. Even if Co is incorporated in amounts larger than 15% by weight, the effect of Co incorporation cannot be heightened any more. Consequently, the content of Co is from 5 to 15% by weight, and preferably from 7 to 14% by weight.

Molybdenum (Mo) not only forms a carbide in the hard particles to improve wear resistance, but also has the effect of improving toughness because it functions to reduce the size of carbide grains. If the Mo content is lower than 0.5% by weight, the incorporation of Mo is less effective. Mo contents higher than 3% by Weight result in too high hardnesses of the hard particles, so that toughness is reduced, far from being improved. Consequently, the content of Mo is from 0.5 to 3% by weight, and preferably from 0.7 to 2.5% by weight.

Titanium (Ti) is an element which has the strongest tendency to generate a nitride and an oxide among the elements constituting the hard particles. Titanium has the effect of improving the toughness and the resistance to compressive deformation of the hard particles, because during melting of raw materials for hard particle production, part of Ti reacts with nitrogen and oxygen in the atmosphere to form titanium nitride and titanium oxide and these compounds uniformly disperse into the hard particles. If the Ti content is lower than 0.03% by weight, the incorporation of Ti is less effective. Ti contents higher than 0.5% by weight result in too high hardnesses of the hard particles, so that toughness is reduced, far from being improved. Consequently, the content of Ti is from 0.03 to 0.5% by weight, and preferably from 0.05 to 0.3% by weight.

By using the composition described above, the hard particles A not only can have a Vickers hardness of from 1,100 to 1,500, which range is suitable for ensuring wear resistance, but also can have higher toughness and higher resistance to compressive deformation than the hard particles having a composition consisting of C, Cr, W, Co, and Fe, which are contained in conventional valve seat materials. Thus, the hard particles A can be inhibited from being broken by the impacts, in particular knocking impacts, caused by valves. As a result, wear resistance can be improved.

In order that the hard particles A be effectively held in the matrix and have enhanced resistance to breakage and falling, it is desirable to increase the contact area between the hard particles A and the matrix by imparting a smooth unevenness on the surface of the hard particles A. Hard particles having such a surface cannot be obtained by the pulverization method or a gas atomization method, but can be produced by a water atomization method, as described, e.g., in *Journal of Metals*, April 1984, p. 20 et seq. It is therefore preferred that the raw material powder for the hard particles A is produced by water atomization.

The hard particles B are then explained with respect to the composition thereof.

Molybdenum (Mo) forms an Fe-Mo intermetallic compound to improve wear resistance. If the Mo content is lower than 60% by weight, the amount of the intermetallic compound formed is so small that the effect of improving wear resistance is insufficient. Mo contents higher than 70% by weight result in the excessive formation of the intermetallic compound to reduce the toughness of the hard particles. Consequently, the content of Mo is from 60 to 70% by weight, and preferably from 63 to 67% by weight.

Silicon (Si) serves to improve the hardness of the hard particles to improve wear resistance. If the Si content is lower than 0.5% by weight, the incorporation of Si is less effective. Si contents higher than 2% by weight result in impaired toughness of the hard particles. Consequently, the content of Si is from 0.5 to 2% by weight, and preferably from 0.7 to 1.5% by weight.

Due to the composition described above, an Fe-Mo intermetallic compound is formed to enable the hard particles B to have a Vickers hardness of from 1,100 to 1,300. The Fe-Mo intermetallic compound functions to reduce the coefficient of sliding friction. The hard particles B therefore have the effect of inhibiting the valve seats from adhering and being worn by the impacts, in particular the sliding impacts, caused by valves.

Since the hard particles B generally have a high melting point of about from 1,500° to 1,600° C., they are difficult to be produced by an atomization method. Thus, the hard particles B are preferably produced by a pulverization method.

In order to effectively inhibit both the wear by the impacts caused by valve knocking and the wear by the impacts caused by valve sliding, the hard particles A and B should be incorporated simultaneously. Improvement in wear resistance can be attained due to the synergistic effect of the two kinds of particles. If the total incorporation amount of the hard particles A and B is smaller than 10% by weight, sufficient wear resistance cannot be obtained. If the amount thereof is larger than 25% by weight, attack on valves by valve seats is enhanced, resulting in an increased valve wear loss. Consequently, the total amount of the hard particles A and B is from 10 to 25% by weight, and preferably from 11 to 22% by weight.

The proportion of the hard particles A to the hard particles B is not particularly limited. Since the impacts caused by valve knocking exerts a greater influence on valve seat wear than the impacts caused by valve sliding, it is preferred that the ratio of the content of the hard particles A to that of the hard particles B be in the range of from 2 to 20 by weight.

The average particle diameter of the hard particles A and that of the hard particles B each is preferably from 30 to 80μm. This is because if the average particle diameter thereof is smaller than 30μm, the hard particles tend to aggregate and the aggregated particles tend to fall from the matrix, and if the average particle diameter thereof is larger than 80 μm, attack on valves is enhanced, resulting in an increased valve wear loss.

For the purpose of heightening the effect of inhibiting the wear caused by adhesion between valves and valve seats, it is preferred to uniformly disperse $CaF_2$ as a lubricant into the matrix. The dispersed $CaF_2$ produces a synergistic effect with the sintered ferrous alloy of the present invention to function, in particular, to reduce attack on valves. If the $CaF_2$ content is lower than 0.3% by weight based on the total amount of the alloy, the incorporation thereof is less effective. $CaF_2$ contents higher than 2% by weight result in reduced valve seat strength and pitting wear because of poor bonding between the lubricant and the matrix. Consequently, the content of $CaF_2$ is preferably from 0.3 to 2% by weight based on the total amount of the alloy.

Copper (Cu) may be incorporated into pores of the sintered ferrous alloy of the present invention by infiltration in an amount of from 10 to 20% by volume based on the total amount of the alloy. The copper incorporated in the pores by infiltration serves to improve thermal conductivity. The copper also functions as a lubricant to inhibit adhesion, because it undergoes plastic deformation due to the impacts caused by valves and is thus spread on the valve seat surface. In addition, the infiltrated Cu produces a synergistic effect with the sintered alloy to improve the wear resistance of the valve seat. If the amount of the infiltrated Cu is smaller than 10% by volume, the infiltration of Cu is less effective. If the amount thereof is larger than 20% by volume, the matrix should have an increased pore volume because of the necessity of a larger Cu infiltration space, resulting in reduced strength and pitting wear. Thus, infiltrated Cu amounts outside the above-specified range are not preferred.

The method for producing the wear-resistant sintered ferrous alloy according to the present invention is not particularly limited. In one embodiment, raw material powder for forming an iron-based matrix is mixed with raw material powder for forming the hard particles and other additives, and the resulting mixture is then compacted and sintered.

The raw material powder for forming an iron-based matrix can be prepared by mixing pure iron powder with carbon, nickel, molybdenum, manganese, and cobalt in a form of powder. In order to enhance the effects of addition of these elements, at least one of nickel, molybdenum, manganese, and cobalt are previously prealloyed with the pure iron powder. Graphite powder as a carbon source is preferably mixed with the prealloyed powder because if carbon is prealloyed, the compressibility of the resulting mixture tends to be deteriorated.

A lubricant for compacting such as zinc stearate is mixed with the resulting mixture to prevent wearing of a die assembly, and raw material powder for forming the hard particles and $CaF_2$ powder is further mixed to prepare a final mixture for compacting.

The compacted final mixture is then sintered and infiltrated preferably at a sintering and infiltrating temperature of preferably from 1,120° to 1,150° C for 20 to 80 minutes in a nitrogen atmosphere or a reducing atmosphere. By controlling the cooling conditions, the structure of the iron-based matrix can be pearlite structure, or can be sorbite structure by quenching and tempering. In order to ensure the strength of the wear-resistant sintered alloy of the present invention as well as its wearing resistance, it is preferred that the iron-based matrix has sorbite structure through heat treatments.

The present invention will be described in more detail below with reference to specific examples, but the present invention should not be construed as been limited thereto.

EXAMPLE 1

Prealloyed powder consisting of 2% by weight of Ni, 1.5% by weight of Mo, 0.3% by weight of Mn, and the balance of Fe was mixed with 5% by weight, based on the total weight of the raw material powder, of Co powder and 1% by weight, based on the total weight of the raw material powder, of graphite powder. Thereto was added 0.8% by weight of zinc stearate as a lubricant for compacting. Thus, mixed raw material powder for forming an iron-based matrix.

Raw material powder for forming hard particles A having the composition shown in Table 1 below and raw material powder for forming hard particles B consisting of 65% by weight of Mo, 1% by weight of Si, and the balance of Fe were mixed with the above raw material powder for forming the matrix, to prepare a mixture.

The raw material powder for forming the hard particles A was produced by the water atomization method and has an average particle diameter of 60 μm. The raw material powder for forming the hard particles B was produced by the pulverization method and having an average particle diameter of 45 μm.

TABLE 1

| Sample | Composition of hard particles A (% by weight) | | | | | | | Hard particles content (% by weight) | | |
|---|---|---|---|---|---|---|---|---|---|---|
| | C | Cr | W | Co | Mo | Ti | Fe | A | B | Total |
| 1 | 2 | 42 | 21 | 10 | 2 | 0.1 | balance | 8 | 3 | 11 |
| 2 | 2 | 42 | 21 | 10 | 2 | 0.1 | balance | 12 | 5 | 17 |
| 3 | 2 | 42 | 21 | 10 | 2 | 0.1 | balance | 16 | 6 | 22 |
| 4 | 2 | 45 | 27 | 14 | 2.5 | 0.3 | balance | 12 | 5 | 17 |
| 5 | 2 | 40 | 23 | 12 | 1.4 | 0.2 | balance | 12 | 5 | 17 |
| 6 | 2 | 38 | 19 | 7 | 0.7 | 0.05 | balance | 12 | 5 | 17 |
| 7* | 2 | 42 | 21 | 10 | 0.1 | 0.1 | balance | 12 | 5 | 17 |
| 8* | 2 | 42 | 21 | 10 | 5 | 0.1 | balance | 12 | 5 | 17 |
| 9* | 2 | 42 | 21 | 10 | 2 | 0.01 | balance | 12 | 5 | 17 |
| 10* | 2 | 42 | 21 | 10 | 2 | 1 | balance | 12 | 5 | 17 |
| 11* | — | — | — | — | — | — | — | 0 | 15 | 15 |
| 12* | 2 | 42 | 21 | 10 | 2 | 0.1 | balance | 15 | 0 | 15 |

Note:
The samples 7 to 12 indicated with * are comparative samples.

The mixture of the mixed raw material powder for forming an iron-based matrix, the raw material powder for forming the hard particles A, and the raw material powder for forming the hard particles B was compacted under a compacting pressure of 7 t/cm$^2$ into a ring shape having an outer diameter of 34 mm, an inner diameter of 27 mm, and a height of 7 mm. The resulting compact was dewaxed at 600° C. for 30 minutes and then sintered in a nitrogen atmosphere at 1,130° C. for 1 hour. Thereafter, the resulting sinter was heated at 870° C. for 60 minutes, cooled in an oil, and then subjected to a high temperature tempering treatment to obtain a matrix of homogeneous sorbite structure having a Vickers hardness of 380.

The samples were machined into a valve seat form, and evaluated for valve seat wear loss and valve wear loss using a abrasion tester. In this tester, a valve is reciprocated by the rotation of a camshaft, and the wear of the valve seat by repeated knocking by the valve is tested in a high-temperature combustion gas atmosphere. The conditions for this abrasion test included a valve material of SUH36 (valve face being clad with stellite No. 6), a valve seat surface temperature of 450° C., a camshaft rotational speed of 3,500 rpm, and an operation time of 100 hours. The wear loss of the valve seat was expressed in terms of an increase in the width of the area in contact with the valve, while that of the valve was expressed in terms of the maximum depth of the worn part of the valve face. The results of the test are shown in Table 2.

TABLE 2

| Sample | Wear loss | |
|---|---|---|
| | Valve seat (μm) | Valve (μm) |
| 1 | 61 | 29 |
| 2 | 45 | 32 |

TABLE 2-continued

| Sample | Wear loss | |
|---|---|---|
| | Valve seat (μm) | Valve (μm) |
| 3 | 43 | 41 |
| 4 | 55 | 35 |
| 5 | 48 | 37 |

TABLE 2-continued

| Sample | Wear loss | |
|---|---|---|
| | Valve seat (μm) | Valve (μm) |
| 6 | 52 | 32 |
| 7* | 124 | 62 |
| 8* | 109 | 71 |
| 9* | 111 | 68 |
| 10* | 107 | 74 |
| 11* | 136 | 52 |
| 12* | 103 | 51 |

Note:
The samples 7 to 12 indicated wtih * are comparative samples.

The above results show that the valve seat samples of the present invention were lower in both valve seat wear loss and valve wear loss than the comparative samples. In particular, the results show that wear resistance is improved by regulating the composition of the hard particles A so as to simultaneously have an Mo content and a Ti content in the respective given ranges.

EXAMPLE 2

The prealloyed powder, the Co powder, and the graphite powder each having the same compositions as in Example 1 were mixed in the same proportion as in Example 1. Zinc stearate as a lubricant for compacting was added thereto in the same manner as in Example 1 to prepare mixed raw material powder for forming an iron-based matrix. The composition of the matrix was 2% by weight of Ni, 1.5% by weight of Mo, 0.3% by weight of Mn, 5% by weight of Co, 1% by weight of C, and the balance of Fe.

The same raw material powder for forming the hard particles A as in Sample 2 of Example 1 (composition: Fe, 2% by weight C, 42% by weight Cr, 21% by weight W, 10% by weight Co, 2% by weight Mo, and 0.1% by weight Ti; average particle diameter, 60μm) and the same raw material powder for forming the hard particles B as in Sample 2 of Example 1 (composition: Fe, 65% by weight Mo, and 1% by weight Si; average particle diameter, 45μm) were mixed with the mixed raw material powder for forming an iron-based matrix obtained above in the same ratio as in Sample 2 of Example 1.

$CaF_2$ powder was mixed with the resulting raw material powder mixture in such an amount to result in the $CaF_2$ contents shown in Table 3 below. Each of the resulting $CaF_2$-containing raw material powder mixtures and the powder mixture not containing $CaF_2$ was compacted, dewaxed, and then sintered under the same conditions as in Example 1. Part of the sintered samples thus obtained were infiltrated with Cu by placing a ring-form Cu powder compact for infiltration on the sample and heating the assemblage at 1,130° C. for 20 minutes in a nitrogen atmosphere to allow the Cu to infiltrate into the pores in such an amount to result in the Cu contents shown in Table 3. Thereafter, all samples were heat-treated under the same conditions as in Example 1.

Each of the valve seat samples obtained was subjected to the abrasion test under the same conditions as in Example 1 to evaluate the wear losses in the same manner as in Example 1. The results obtained are shown in Table 3.

TABLE 3

| Sample | $CaF_2$ content (% by weight) | Infiltrated Cu amount (% by volume) | Wear Loss Valve seat (μm) | Wear Loss Valve (μm) |
|---|---|---|---|---|
| 13 | 0.5 | — | 43 | 27 |
| 14 | 1 | — | 40 | 25 |
| 15 | 1.8 | — | 48 | 22 |
| 16 | 2.5 | — | 98 | 54 |
| 17 | — | 12 | 41 | 37 |
| 18 | — | 15 | 39 | 35 |
| 19 | — | 18 | 44 | 41 |
| 20 | — | 22 | 95 | 61 |
| 21 | 1 | 12 | 38 | 28 |
| 22 | 1 | 15 | 37 | 29 |
| 23 | 1 | 18 | 45 | 35 |
| 24 | 1 | 22 | 91 | 50 |

The above results show that each of the valve seat samples of the present invention containing $CaF_2$ and/or infiltrated Cu in amounts within the respective ranges was further improved in both valve seat wear loss and valve wear loss.

According to the present invention, a wear-resistant sintered ferrous alloy for valve seats reduced in valve seat wear and valve wear can be provided by improving the ductility of the matrix to not only improve the ability to hold hard particles but also buffer impacts on hard particles, thereby inhibiting the breakage of hard particles and the falling of the particles from the valve seats, and by also improving the hard particles with respect to resistance to wear by the impacts caused by valves.

Furthermore, a wear-resistant sintered ferrous alloy for valve seats which is even more reduced in adhesive wear can be provided by incorporating $CaF_2$ as a lubricating ingredient and/or by infiltrating Cu.

While the invention has been described in detail and with reference to specific examples thereof, it will be apparent to one skilled in the art that various changes and modifications can be made therein without departing from the spirit and scope thereof.

What is claimed is:

1. A wear-resistant sintered ferrous alloy for use as a valve seat, said alloy comprising an iron-based matrix having a sorbite or pearlite structure consisting of 0.5 to 1.5% by weight of C, 0.5 to 3% by weight of Ni, 0.5 to 2% by weight of Mo, 0.1 to 8% by weight of Co, 0.05 to 1% by weight of Mn, and the balance of Fe, with unavoidable impurities, and having a Vickers hardness of from 300 to 450;

hard particles A consisting of 1.5 to 2.5% by weight of C, 38 to 45% by weight of Cr, 18 to 30% by weight of W, 5 to 15% by weight of Co, 0.5 to 3% by weight of Mo, 0.03 to 0.5% by weight of Ti, and the balance of Fe, with unavoidable impurities, and having an average particle diameter of from 30 to 80μm; and hard particles B consisting of 60 to 70% by weight of Mo, 0.5 to 2% by weight of Si, and the balance of Fe, with unavoidable impurities, and having an average particle diameter of from 30 to 80μm, said hard particles A and said hard particles B being uniformly dispersed in said iron-based matrix in a total amount of from 10 to 25% by weight based on the total weight of said iron-based matrix, said hard particles A, and said hard particles B.

2. A wear-resistant sintered ferrous alloy as claimed in claim 1, wherein said alloy further comprises $CaF_2$ uniformly dispersed in said iron-based matrix in an amount of from 0.3 to 2% by weight based on the total amount of said alloy.

3. A wear-resistant sintered ferrous alloy as claimed in claim 1, wherein said alloy further comprises copper incorporated in pores of said iron-based matrix by infiltration in an amount of from 10 to 20% by volume based on the total amount of said alloy.

4. A wear-resistant sintered ferrous alloy as claimed in claim 2, wherein said alloy further comprises copper incorporated in pores of said iron-based matrix by infiltration in an amount of from 10 to 20% by volume based on the total amount of said alloy.

5. A wear-resistant sintered ferrous alloy as claimed in claim 1, wherein the ratio of the content of said hard particles A to the content of said hard particles B is in the range of from 2 to 20 by weight.

6. A wear-resistant sintered ferrous alloy as claimed in claim 2, wherein the ratio of the content of said hard particles A to the content of said hard particles B is in the range of from 2 to 20 by weight.

7. A wear-resistant sintered ferrous alloy as claimed in claim 3, wherein the ratio of the content of said hard particles A to the content of said hard particles B is in the range of from 2 to 20 by weight.

8. A wear-resistant sintered ferrous alloy as claimed in claim 4, wherein the ratio of the content of said hard particles A to the content of said hard particles B is in the range of from 2 to 20 by weight.

9. A wear-resistant sintered ferrous alloy as claimed in claim 1, wherein raw material powder for forming said hard particle A is produced by a water atomization method.

* * * * *